US010208968B2

(12) United States Patent
Yanase et al.

(10) Patent No.: US 10,208,968 B2
(45) Date of Patent: Feb. 19, 2019

(54) OUTDOOR UNIT

(71) Applicant: Mitsubishi Electric Corporation, Tokyo (JP)

(72) Inventors: Tomoya Yanase, Tokyo (JP); Toshiyuki Kubono, Tokyo (JP); Hiroyuki Jinnai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/520,702

(22) PCT Filed: Dec. 26, 2014

(86) PCT No.: PCT/JP2014/084512

§ 371 (c)(1),
(2) Date: Apr. 20, 2017

(87) PCT Pub. No.: WO2016/103448

PCT Pub. Date: Jun. 30, 2016

(65) Prior Publication Data

US 2017/0314791 A1 Nov. 2, 2017

(51) Int. Cl.
*F24F 1/18* (2011.01)
*F24F 1/36* (2011.01)
(Continued)

(52) U.S. Cl.
CPC ..... *F24F 1/18* (2013.01); *F24F 1/16* (2013.01); *F24F 1/36* (2013.01); *F24F 1/46* (2013.01);
(Continued)

(58) Field of Classification Search
CPC .. F24F 1/18; F24F 13/222; F24F 13/20; F24F 13/30; F24F 1/0007; F24F 1/46; F24F 1/16; F24F 1/56; F24F 1/36; F24F 13/22
See application file for complete search history.

(56) References Cited

U.S. PATENT DOCUMENTS

2010/0294466 A1* 11/2010 Shimaoka ..... F24F 1/24 165/104.33
2014/0144167 A1* 5/2014 Yamauchi ..... F24F 1/16 62/259.1
(Continued)

FOREIGN PATENT DOCUMENTS

CN 204006415 U 12/2014
EP 1 403 589 A1 3/2004
(Continued)

OTHER PUBLICATIONS

Office Action dated Dec. 5, 2017 corresponding to JP patent application No. 2016-565802 (and English translation attached).
(Continued)

*Primary Examiner* — Emmanuel Duke
(74) *Attorney, Agent, or Firm* — Posz Law Group, PLC

(57) ABSTRACT

An outdoor unit according to the present invention includes: a casing; and a heat exchanger accommodated in the casing. The casing includes a bottom panel on a bottom surface of the casing. The bottom panel includes: a first bottom plate portion formed below the heat exchanger; and a second bottom plate portion formed on the bottom panel at a portion other than the first bottom plate portion. A lower end of the heat exchanger is arranged at a position above any point on an upper surface of the first bottom plate portion and below any point on an upper surface of the second bottom plate portion.

9 Claims, 9 Drawing Sheets

(51) Int. Cl.

| | |
|---|---|
| ***F24F 1/56*** | (2011.01) |
| ***F24F 13/20*** | (2006.01) |
| ***F24F 13/22*** | (2006.01) |
| ***F24F 13/30*** | (2006.01) |
| ***F24F 1/16*** | (2011.01) |
| ***F24F 1/46*** | (2011.01) |

(52) U.S. Cl.
CPC ..... *F24F 1/56* (2013.01); *F24F 13/20* (2013.01); *F24F 13/222* (2013.01); *F24F 13/30* (2013.01)

(56) References Cited

U.S. PATENT DOCUMENTS

| | | | | |
|---|---|---|---|---|
| 2014/0165640 | A1* | 6/2014 | Takeuchi | F25D 21/14 62/275 |
| 2014/0202191 | A1* | 7/2014 | Jinnai | F25D 21/14 62/275 |
| 2015/0027670 | A1 | 1/2015 | Jinnai et al. | |

FOREIGN PATENT DOCUMENTS

| | | | | | |
|---|---|---|---|---|---|
| EP | 2180264 | A2 | * | 4/2010 | |
| JP | 61-119029 | U | | 7/1986 | |
| JP | 2001-165472 | A | | 6/2001 | |
| JP | 2011-145029 | A | | 7/2011 | |
| JP | 2012225563 | A | * | 11/2012 | |
| JP | 2013217525 | A | * | 10/2013 | |
| JP | 2014-098512 | A | | 5/2014 | |
| JP | 2014098512 | A | * | 5/2014 | F24F 13/222 |
| WO | 2011/027709 | A1 | | 3/2011 | |
| WO | 2013/099904 | A1 | | 7/2013 | |

OTHER PUBLICATIONS

International Search Report of the International Searching Authority dated Mar. 31, 2015 for the corresponding International application No. PCT/JP2014/084512 (and English translation).
Extended European Search Report dated Nov. 8, 2016 for the corresponding European patent application No. 14896276.4.

* cited by examiner

SECTIONAL VIEW TAKEN ALONG LINE Y-Y

SECTIONAL VIEW TAKEN ALONG LINE Z-Z

SECTIONAL VIEW TAKEN ALONG LINE X-X

SECTIONAL VIEW TAKEN ALONG LINE W-W

OUTDOOR UNIT

TECHNICAL FIELD

The present invention relates to an outdoor unit for an air-conditioning apparatus.

BACKGROUND ART

Hitherto, in an outdoor unit for an air-conditioning apparatus, a heat exchanger and a blower are accommodated in a casing, and outside air is supplied to the heat exchanger, to thereby exchange heat between the outside air and refrigerant of a refrigeration cycle. When this heat exchanger is to be accommodated in the casing, mounting bases for the heat exchanger are formed on a bottom plate of the casing at a plurality of positions to protrude upward therefrom, and a lower surface of the heat exchanger is mounted on the mounting bases (see, for example, Patent Literature 1).

CITATION LIST

Patent Literature

Patent Literature 1: Japanese Unexamined Patent Application Publication No. 2014-98512

SUMMARY OF INVENTION

Technical Problem

In such a related-art outdoor unit, the mounting bases for the heat exchanger are formed on the bottom plate of the casing to protrude upward therefrom. Thus, there is a problem in that an upper end of the heat exchanger is located at a high position so that an increased height of the casing itself results, thereby leading to upsizing of the casing. Further, there is a problem in that, when the height of the casing is reduced, a height of the heat exchanger is reduced to reduce the heat transfer area, thereby leading to degradation of heat exchange efficiency.

Further, a drainage hole for discharging drain water (rainwater or defrost water) accumulated on the bottom plate is formed without a significant level difference from a surrounding portion on the bottom plate. Thus, there is also a problem in that, when a large amount of the drain water is generated, the drain water overflows on the entire bottom plate to flow into a machine chamber accommodating a compressor or other components therein, or that the drain water freezes on the bottom plate.

The present invention has been made in view of the above-mentioned problems, and an object of the present invention is to provide an outdoor unit for an air-conditioning apparatus, which is capable of securing, even when a height of a casing is reduced for downsizing, the heat transfer area of a heat exchanger to guarantee heat exchange performance, and is further capable of reliably discharging drain water on a bottom plate of the casing.

Solution to Problem

According to one embodiment of the present invention, there is provided an outdoor unit, comprising: a casing; and a heat exchanger accommodated in the casing, wherein the casing includes a bottom panel on a bottom surface of the casing, the bottom panel includes a first bottom plate portion formed below the heat exchanger, and a second bottom plate portion formed on the bottom panel at a portion other than the first bottom plate portion, and a lower end of the heat exchanger is arranged at a position above any point on an upper surface of the first bottom plate portion and below any point on an upper surface of the second bottom plate portion.

Advantageous Effects of Invention

According to the outdoor unit of the one embodiment of the present invention, the lower end of the heat exchanger is arranged at the position above any point on the upper surface of the first bottom plate portion and below any point on the upper surface of the second bottom plate portion. Thus, even when the height of the casing is reduced, the heat transfer area of the heat exchanger can be secured to guarantee the heat exchange performance, and further the drain water on the bottom plate of the casing can reliably be discharged.

DESCRIPTION OF EMBODIMENTS

Figure 1:
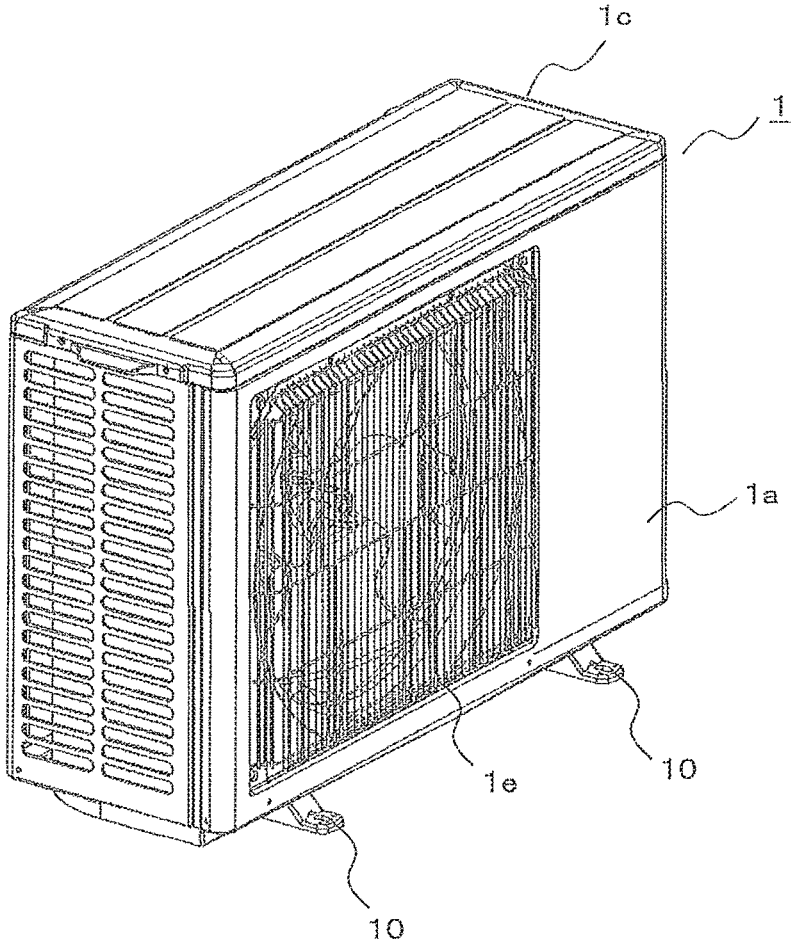
FIG. 1 is a perspective view of an outdoor unit according to Embodiment 1.

Now, an outdoor unit for an air-conditioning apparatus according to the present invention is described with reference to the drawings.

A configuration of the outdoor unit described below is merely an example, and the outdoor unit according to the present invention is not limited to such configuration. Further, in the drawings, the same or similar components are denoted by the same reference symbols, or the reference symbols therefor are omitted. Further, the illustration of details in the structure is appropriately simplified or omitted. Further, overlapping description or similar description is appropriately simplified or omitted.

Embodiment 1

An outdoor unit according to Embodiment 1 is described.

<Configuration of Outdoor Unit>

FIG. 1 is a perspective view of the outdoor unit according to Embodiment 1.

Figure 2:
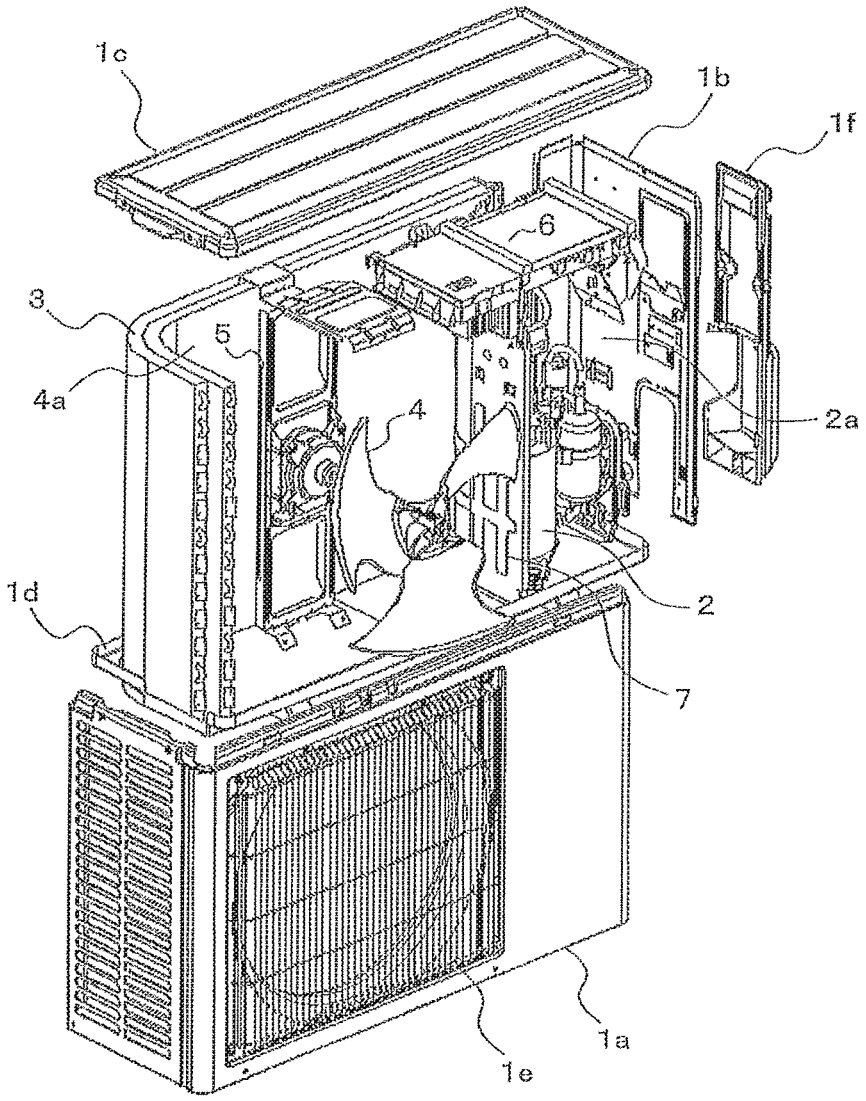
FIG. 2 is an exploded perspective view of the outdoor unit according to Embodiment 1.

FIG. 2 is an exploded perspective view of the outdoor unit according to Embodiment 1.

Figure 3:
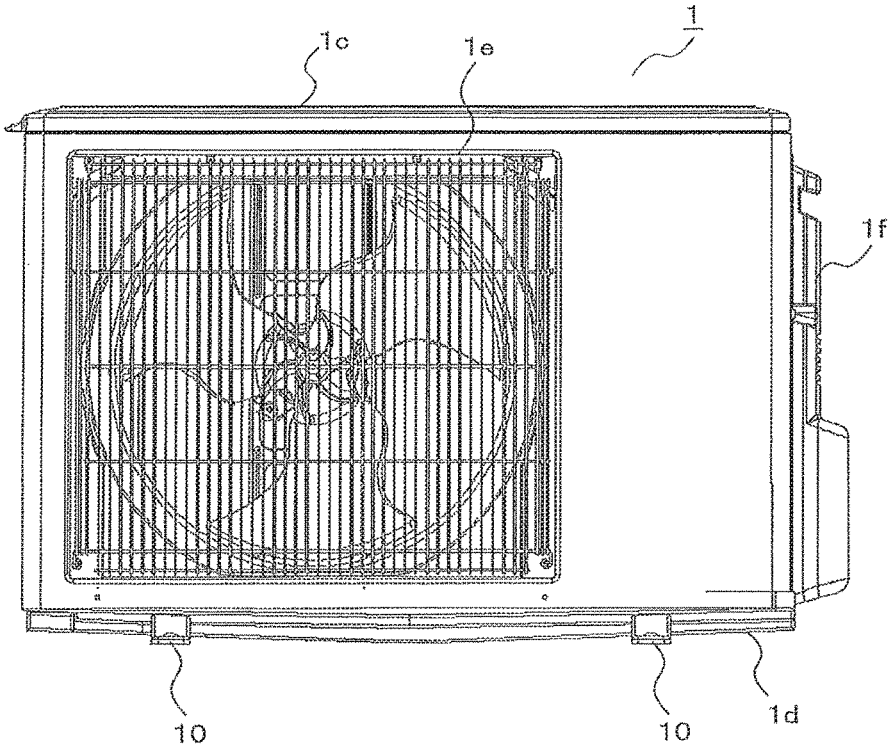
FIG. 3 is a front view of the outdoor unit according to Embodiment 1.

FIG. 3 is a front view of the outdoor unit according to Embodiment 1.

Figure 4:
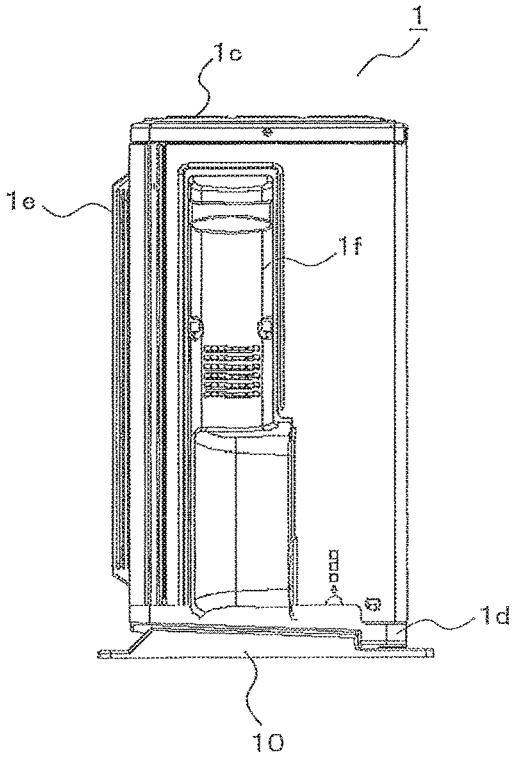
FIG. 4 is a side view of the outdoor unit according to Embodiment 1.

FIG. 4 is a side view of the outdoor unit according to Embodiment 1.

As illustrated in FIG. 1, a casing 1 of the outdoor unit is formed of a sheet metal having a substantially rectangular parallelepiped shape. As illustrated in FIG. 2, the casing 1 mainly includes an L-shaped front panel 1*a* arranged on a front side of the casing 1, a side panel 1*b* covering a side surface of the casing 1, a top panel 1*c* covering an upper surface of the casing 1, and a bottom panel 1*d* arranged on a bottom surface of the casing 1. Further, a front grille 1*e* having openings is mounted on the front panel 1*a*, and a side cover 1*f* covering electrical components such as a terminal block is mounted on the side panel 1*b*.

Further, two foot portions 10 for supporting the outdoor unit are arranged on a lower surface of the bottom panel 1*d* of the casing 1.

The casing 1 accommodates therein a compressor 2 for compressing refrigerant, an outdoor heat exchanger 3 for exchanging heat between outside air and the refrigerant, a blower 4 for supplying the outside air to the outdoor heat exchanger 3, a support base 5 for supporting the blower 4, on which a motor for the blower is mounted, and an electrical component box 6 for controlling actuators in the outdoor unit.

Further, a blower chamber 4*a* in which the blower 4 is arranged and a machine chamber 2*a* in which the compressor 2 is arranged are partitioned by a partition plate 7.

The outdoor heat exchanger 3 is a fin-and-tube heat exchanger in which, for example, heat transfer tubes pass through a plurality of aluminum thin plate-like fins arranged side by side. The entirety of the outdoor heat exchanger 3 is entirely formed into a substantially L-shape, and is arranged along two side surfaces of the casing 1. The fins are arranged upright in a perpendicular direction, and the heat transfer tubes pass through the fins in a horizontal direction.

The blower 4 is arranged in the vicinity of the outdoor heat exchanger 3. Rotation of the blower 4 causes the outside air to pass between the fins of the outdoor heat exchanger 3, and at this time, heat is exchanged between the refrigerant flowing through the heat transfer tubes of the outdoor heat exchanger 3 and the outside air. The outside air after the heat exchange is exhausted to an outside of the casing 1 through the front grille 1*e*.

When such an outdoor unit for an air-conditioning apparatus is operated, for example, during a heating operation, the outdoor heat exchanger 3 functions as an evaporator, and low-pressure gas refrigerant evaporated by receiving heat from the outside air is compressed into high-pressure gas refrigerant by the compressor 2, and is supplied to an indoor heat exchanger (not shown) of an indoor unit.

On the other hand, during a cooling operation, the outdoor heat exchanger 3 functions as a condenser, and high-pressure gas refrigerant compressed by the compressor 2 rejects heat to the outside air to be condensed in the outdoor heat exchanger 3. Then, the condensed liquid refrigerant is decompressed and supplied to the indoor heat exchanger (not shown) of the indoor unit.

<Configuration of Bottom Panel>

Figure 5:
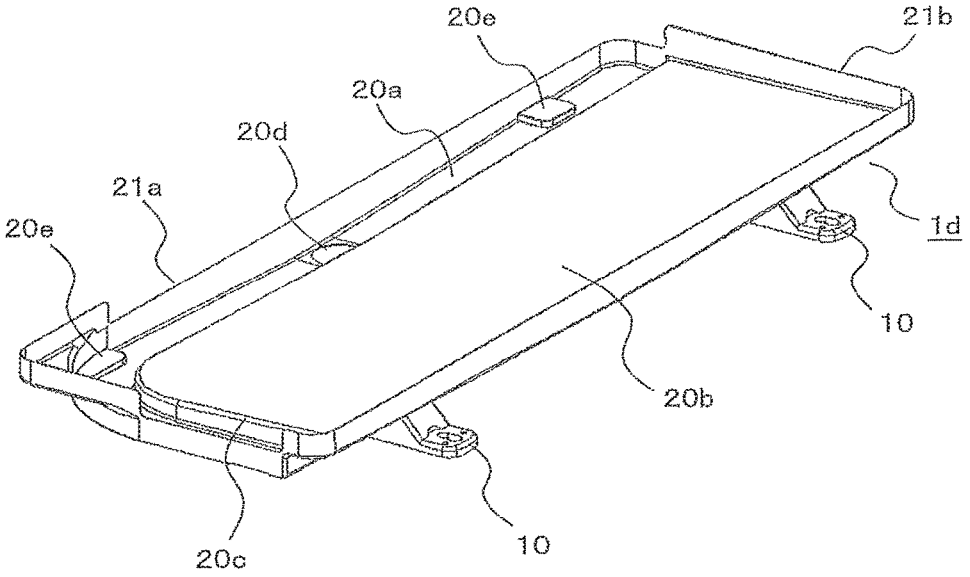
FIG. 5 is a perspective view of a bottom panel of the outdoor unit according to Embodiment 1.

FIG. 5 is a perspective view of the bottom panel of the outdoor unit according to Embodiment 1.

Figure 6:
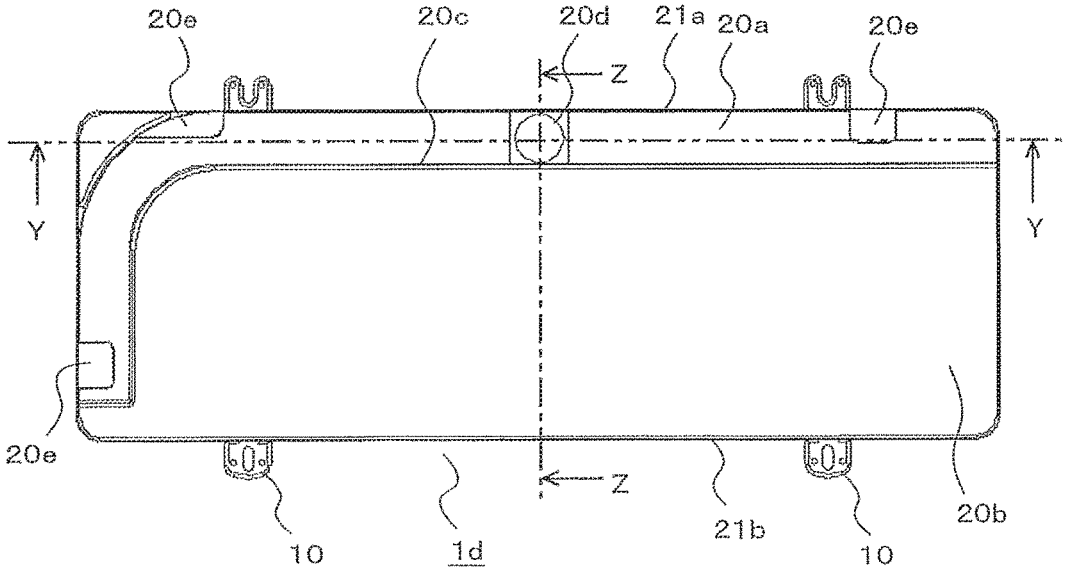
FIG. 6 is a plan view of the bottom panel of the outdoor unit according to Embodiment 1.

FIG. 6 is a plan view of the bottom panel of the outdoor unit according to Embodiment 1.

Figure 7:
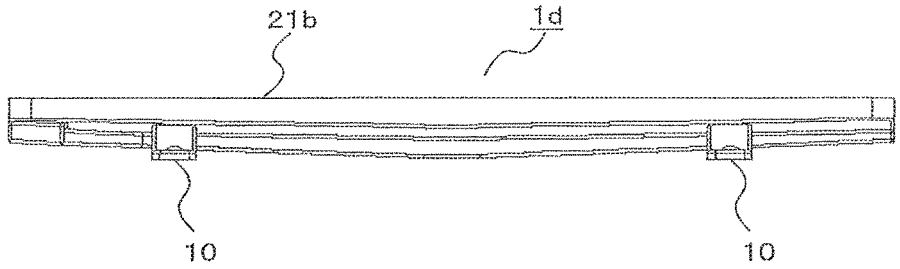
FIG. 7 is a longitudinal side view of the bottom panel of the outdoor unit according to Embodiment 1.

FIG. 7 is a longitudinal side view of the bottom panel of the outdoor unit according to Embodiment 1.

Figure 8:
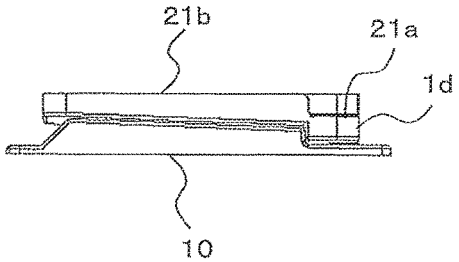
FIG. 8 is a transverse side view of the bottom panel of the outdoor unit according to Embodiment 1.

FIG. 8 is a transverse side view of the bottom panel of the outdoor unit according to Embodiment 1.

Figure 9:
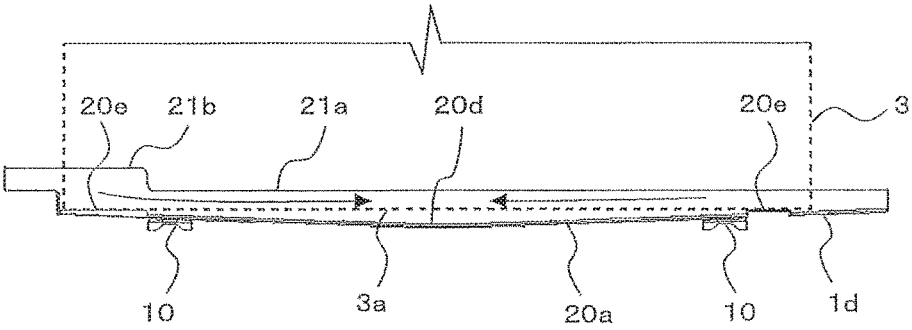
FIG. 9 is a sectional view of the bottom panel of the outdoor unit according to Embodiment 1 taken along the line Y-Y of FIG. 6.

FIG. 9 is a sectional view of the bottom panel of the outdoor unit according to Embodiment 1 taken along the line Y-Y of FIG. 6.

Figure 10:
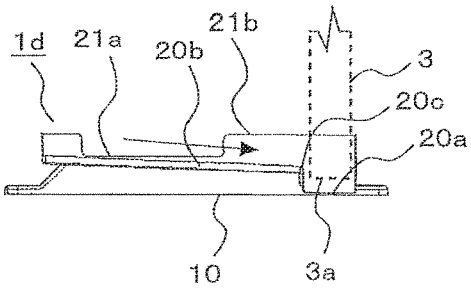
FIG. 10 is a sectional view of the bottom panel of the outdoor unit according to Embodiment 1 taken along the line Z-Z of FIG. 6.

FIG. 10 is a sectional view of the bottom panel of the outdoor unit according to Embodiment 1 taken along the line Z-Z of FIG. 6.

The bottom panel 1*d* mainly includes a first bottom plate portion 20*a* formed below the outdoor heat exchanger 3, and a second bottom plate portion 20*b* formed at a position above the first bottom plate portion 20*a* in a vertical direction.

In the second bottom plate portion 20*b*, mounting portions for respective devices of the outdoor unit (such as the compressor 2, the outdoor heat exchanger 3, and the support base 5 for the blower 4) are formed in a concavo-convex pattern, for example, through press working (not shown).

As illustrated in FIG. 6, the first bottom plate portion 20*a* is formed below the outdoor heat exchanger 3 formed into a substantially L-shape in top view, and has a substantially L-shape conforming to the peripheral shape of the outdoor heat exchanger 3.

As illustrated in FIG. 6, a circular drainage hole 20*d* for discharging drain water on the bottom panel 1*d* is opened substantially at the center in a longitudinal direction of the first bottom plate portion 20*a*. As illustrated in the sectional view of FIG. 9, the first bottom plate portion 20*a* has formed thereon inclined surfaces inclined downward to the drainage hole 20*d* from both end portions thereof (sloped down in directions indicated by the arrows in FIG. 9).

Further, as illustrated in the sectional view of FIG. 10, the second bottom plate portion 20*b* also has formed thereon an inclined surface inclined downward to the drainage hole 20*d* (sloped down in a direction indicated by the arrow in FIG. 10).

The drain water generated in the outdoor heat exchanger 3 or rainwater entering the casing 1 through the front grille 1*e* of the casing 1 or outside-air inlets formed around the outdoor heat exchanger 3 passes along the slope on the second bottom plate portion 20*b* to flow into the first bottom plate portion 20*a*. Further, the water flows down along the slopes on the first bottom plate portion 20*a*, and is discharged to the outside of the casing 1 through the drainage hole 20*d*.

The drainage hole 20*d* is formed at the lowermost position on the bottom panel 1*d* in the vertical direction. A hose or other such component is connected to the drainage hole 20*d* at a portion below the bottom panel 1*d* so that the drain water is guided to the outside of the outdoor unit through the hose, and is discharged to, for example, a drain sewer around a construction.

Further, mounting bases 20*e* for mounting the outdoor heat exchanger 3 are formed at three positions on the first bottom plate portion 20*a*. The mounting bases 20*e* each have a smooth abutment surface as an upper surface thereof, on which a part of the fins corresponding to a lower end 3*a* of the outdoor heat exchanger 3 is held in abutment. A height of the upper surface of each of the mounting bases 20*e* in the vertical direction is set higher than any point on the upper surface of the first bottom plate portion 20*a* and below any point on the upper surface of the second bottom plate portion 20*b*.

Therefore, the lower end 3*a* of the fins of the outdoor heat exchanger 3 is arranged at a position above any point on the upper surface of the first bottom plate portion 20*a* and below any point on the upper surface of the second bottom plate portion 20*b*.

That is, the part of the bottom panel 1*d* below the outdoor heat exchanger 3 (first bottom plate portion 20*a*) is formed at a position lower by one stage than the other part of the bottom panel 1*d* (second bottom plate portion 20*b*) in the vertical direction.

Further, the first bottom plate portion 20*a* and the second bottom plate portion 20*b* are connected to each other by a tapered shape surface portion 20*c* inclined with respect to the first bottom plate portion 20*a* and the second bottom plate portion 20*b*.

Through the formation of the tapered shape surface portion 20*c* as described above, the outside air passes between the fins at a position of the lower end 3*a* of the outdoor heat exchanger 3, and passes along an upper surface of the tapered shape surface portion 20*c* to smoothly flow toward the second bottom plate portion 20*b* so that the air is sucked into the blower 4.

Further, a flange portion 21 is formed on a peripheral edge of the bottom panel 1*d* to be upright from the bottom panel 1*d* at substantially 90 degrees.

As illustrated in FIG. 5 or other figures, a height of the first flange portion 21*a* in the vertical direction, which corresponds to a part of the flange portion 21 opposed to the heat exchanger 3, is smaller than a height of a second flange portion 21*b* corresponding to a part of the flange portion 21 other than the first flange portion 21*a*.

The height of the first flange portion 21*a* corresponding to the part opposed to the heat exchanger 3 is set lower as described above, thereby smoothly supplying the outside air to the fins at the position of the lower end 3*a* of the outdoor heat exchanger 3.

In other words, a part of the fins corresponding to the lower end 3*a* of the outdoor heat exchanger 3 is sandwiched by the tapered shape surface portion 20*c* and the first flange portion 21*a*, and with those two components, the outside air can be caused to flow through the fins to enhance the heat exchange efficiency.

<Foot Portion>

Figure 11:
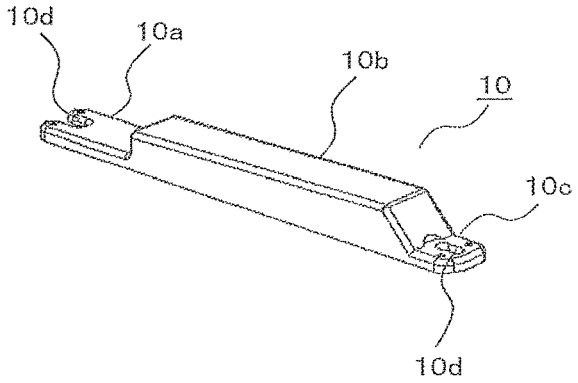
FIG. 11 is a perspective view of a foot portion of the outdoor unit according to Embodiment 1.

FIG. 11 is a perspective view of the foot portion of the outdoor unit according to Embodiment 1.

Figure 12:
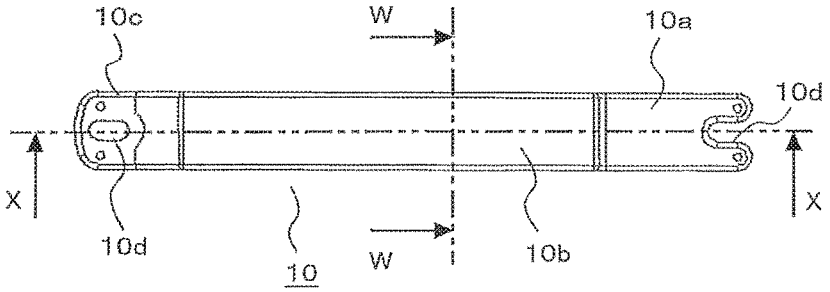
FIG. 12 is a plan view of the foot portion of the outdoor unit according to Embodiment 1.

FIG. 12 is a plan view of the foot portion of the outdoor unit according to Embodiment 1.

Figure 13:
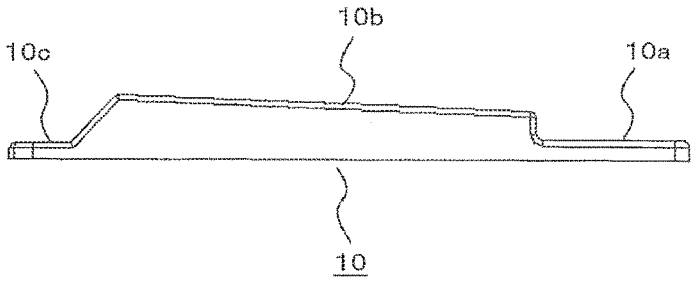
FIG. 13 is a side view of a long side of the foot portion of the outdoor unit according to Embodiment 1.

FIG. 13 is a side view of a long side of the foot portion of the outdoor unit according to Embodiment 1.

Figure 14:
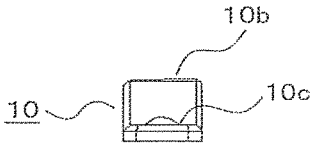
FIG. 14 is a side view of a short side of the foot portion of the outdoor unit according to Embodiment 1.

FIG. 14 is a side view of a short side of the foot portion of the outdoor unit according to Embodiment 1.

Figure 15:
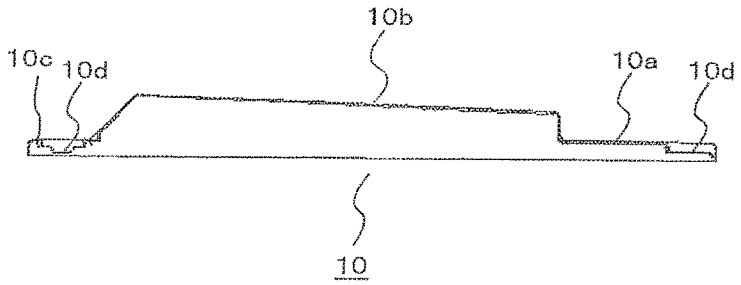
FIG. 15 is a sectional view of the foot portion of the outdoor unit according to Embodiment 1 taken along the line X-X of FIG. 12.

FIG. 15 is a sectional view, taken along the line X-X of FIG. 12, of the foot portion of the outdoor unit according to Embodiment 1.

Figure 16:
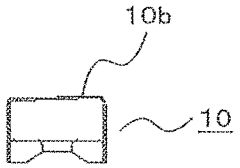
FIG. 16 is a sectional view of the foot portion of the outdoor unit according to Embodiment 1 taken along the line W-W of FIG. 12.

FIG. 16 is a sectional view, taken along the line W-W of FIG. 12, of the foot portion of the outdoor unit according to Embodiment 1.

The two foot portions 10 for supporting the casing 1 are mounted on the lower surface of the bottom panel 1*d* of the casing 1. As illustrated in FIG. 11 to FIG. 16, the foot portion 10 is formed into an elongated shape. Further, the foot portion 10 includes a first upper surface portion 10*a* held in abutment on a lower surface of the first bottom plate portion 20*a* of the bottom panel 1*d* of the casing 1, and a second upper surface portion 10*b* held in abutment on a lower surface of the second bottom plate portion 20*b* of the bottom panel 1*d* of the casing 1.

The first upper surface portion 10*a* of the foot portion 10 is formed at a position lower by one stage than the second upper surface portion 10*b* in the vertical direction. As illustrated in FIG. 13, the second upper surface portion 10*b* is inclined along the lower surface of the first bottom plate portion 20*a* so that the first upper surface portion 10*a* side is the lower side.

Further, the two foot portions 10 are arranged in parallel to each other in a lengthwise direction of the bottom panel 1*d*.

Further, a third upper surface portion 10*c* is formed on a side opposite to the first upper surface portion 10*a* across the second upper surface portion 10*b*. A cutout portion 10*d* is formed in each of a distal end of the first upper surface portion 10*a* and a distal end of the third upper surface portion 10*c*, for inserting a bolt or other fixing members for fixing the foot portion 10 to concrete or other structures.

As described above, the first upper surface portion 10*a* of the foot portion 10 is formed at the position lower by one stage than the second upper surface portion 10*b* in the vertical direction. Thus, the first upper surface portion 10*a* is held in abutment on the lower surface of the first bottom plate portion 20*a* of the bottom panel 1*d*, and the second upper surface portion 10*b* is held in abutment on the lower surface of the second bottom plate portion 20*b*, thereby stably supporting the casing 1.

<Installation of Outdoor Heat Exchanger to Bottom Panel of Casing>

Figure 17:
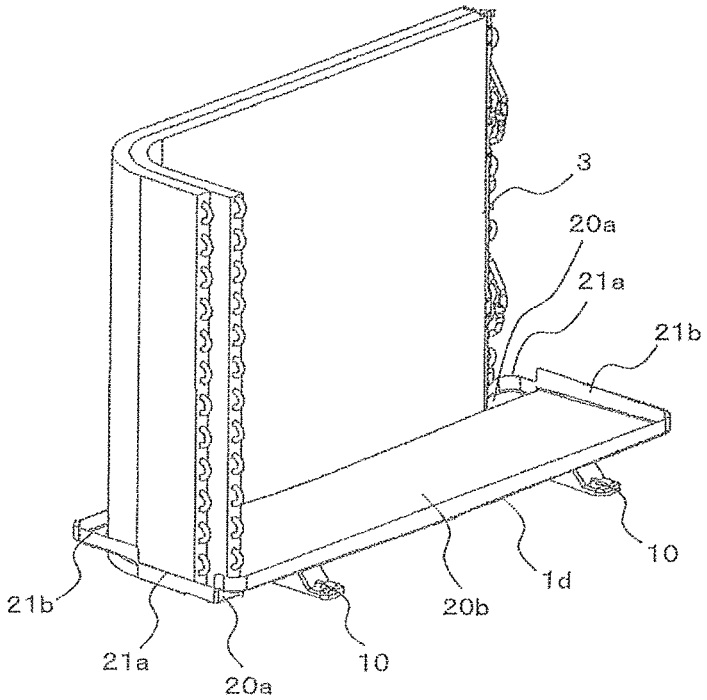
FIG. 17 is an exploded perspective view of a state in which an outdoor heat exchanger is installed on the bottom panel of the outdoor unit according to Embodiment 1.

FIG. 17 is an exploded perspective view of a state in which the outdoor heat exchanger is installed on the bottom panel of the outdoor unit according to Embodiment 1.

Figure 18:
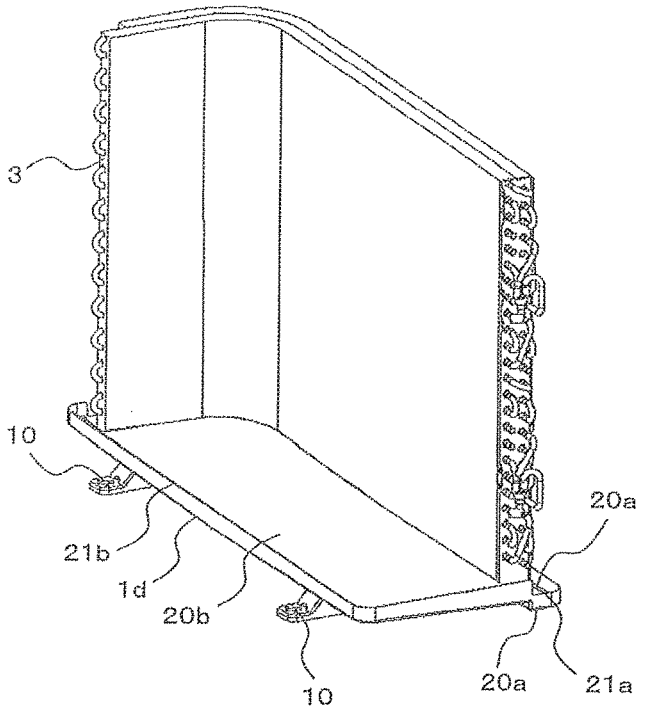
FIG. 18 is an exploded perspective view of the state in which the outdoor heat exchanger is installed on the bottom panel of the outdoor unit according to Embodiment 1.

FIG. 18 is an exploded perspective view of the state in which the outdoor heat exchanger is installed on the bottom panel of the outdoor unit according to Embodiment 1.

Figure 19:
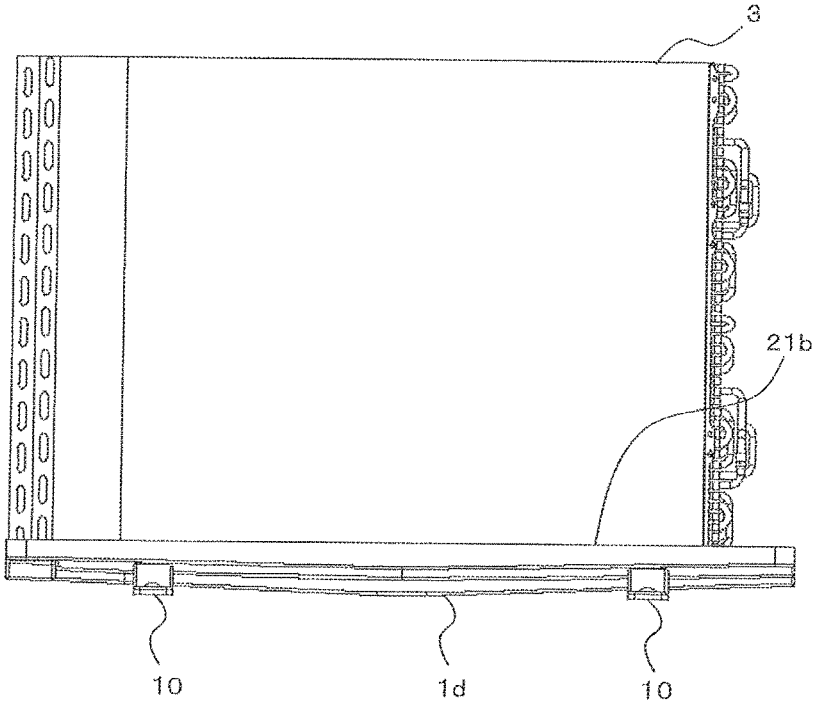
FIG. 19 is a longitudinal side view of the state in which the outdoor heat exchanger is installed on the bottom panel of the outdoor unit according to Embodiment 1.

FIG. 19 is a longitudinal side view of the state in which the outdoor heat exchanger is installed on the bottom panel of the outdoor unit according to Embodiment 1.

Figure 20:
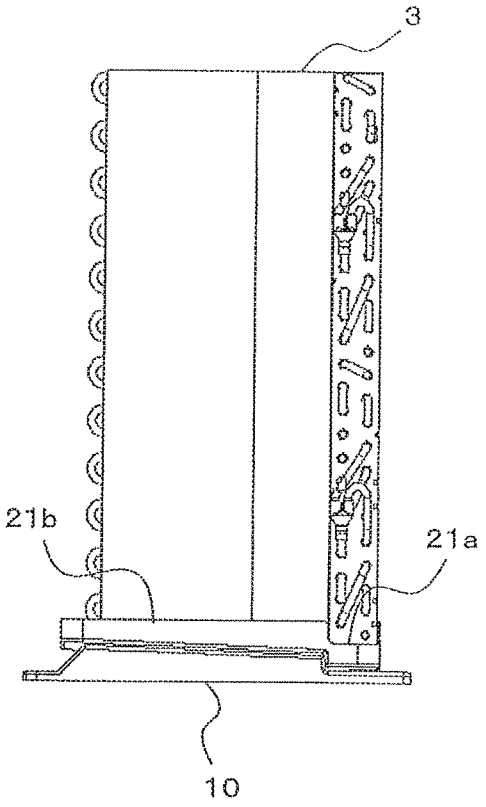
FIG. 20 is a transverse side view of the state in which the outdoor heat exchanger is installed on the bottom panel of the outdoor unit according to Embodiment 1.

FIG. 20 is a transverse side view of the state in which the outdoor heat exchanger is installed on the bottom panel of the outdoor unit according to Embodiment 1.

As illustrated in FIG. 17 to FIG. 20, the outdoor heat exchanger 3 of the outdoor unit according to Embodiment 1 is mounted under a state in which the lower end 3*a* of the fins of the outdoor heat exchanger 3 is accommodated on the first bottom plate portion 20*a* of the bottom panel 1*d* of the casing 1.

In this case, as described above, the lower end 3*a* of the fins of the outdoor heat exchanger 3 is held in abutment on the mounting bases 20*e* on the first bottom plate portion 20*a*.

Then, the lower end 3*a* of the fins of the outdoor heat exchanger 3 is arranged at the position above any point on the upper surface of the first bottom plate portion 20*a* and below any point on the upper surface of the second bottom plate portion 20*b*.

<Advantages>

In the outdoor unit for an air-conditioning apparatus according to Embodiment 1, the drainage hole 20*d* for discharging the drain water (rainwater or defrost water) accumulated on the bottom panel 1*d* is open in the first bottom plate portion 20*a* formed at a position below a peripheral part on the bottom panel 1*d* (second bottom plate portion 20*b*) with a significant level difference therebetween.

Therefore, even when a large amount of the drain water is generated, the drain water flows into the first bottom plate portion 20*a* to be accumulated therein, and the drain water is prevented from overflowing on the entire bottom plate to flow into the machine chamber accommodating the compressor or other components therein, or freezing on the bottom plate.

Further, the bottom panel 1*d* includes the first bottom plate portion 20*a* formed at the position lower by one stage, and the foot portions 10 each also have a shape including the first upper surface portion 10*a* formed at the position lower by one stage in conformity with the first bottom plate portion 20*a*. Thus, the lower end 3*a* of the outdoor heat exchanger 3 can be accommodated on the first bottom plate portion 20*a*, thereby being capable of achieving the reduced height of an upper end of the outdoor heat exchanger 3 as compared to the related art.

Therefore, it is possible to provide a compact outdoor unit reduced in height dimension of the casing 1.

Further, when the height of the casing 1 is dimensioned to be equal to that of the related art, the height dimension of the outdoor heat exchanger 3 can be set larger, thereby being capable of manufacturing an outdoor unit with high heat exchange performance.

REFERENCE SIGNS LIST

1 casing 1*a* front panel 1*b* side panel 1*c* top panel 1*d* bottom panel 1*e* front grille 1*f* side cover 2 compressor 2*a* machine chamber 3 outdoor heat exchanger 3*a* lower end 4 fan 4*a* blower chamber 5 support base 6 electrical component box 7 partition plate 10 foot portion 10*a* first upper surface portion 10*b* second upper surface portion 10*c* third upper surface portion 10*d* cutout portion 20*a* first bottom plate portion 20*b* second bottom plate portion 20*c* tapered shape surface portion 20*d* drainage hole 20*e* mounting base 21 flange portion 21*a* first flange portion 21*b* second flange portion

The invention claimed is:

1. An outdoor unit, comprising:

a casing; and a heat exchanger and a compressor accommodated in the casing, wherein:

the casing includes a bottom panel on a bottom of the casing, the bottom panel includes:

a first bottom plate portion formed below the heat exchanger, and a second bottom plate portion formed at a portion other than the first bottom plate portion, the first bottom plate portion is further formed lower than the second bottom plate portion, the compressor is mounted on the second bottom plate portion, and a lower end of the heat exchanger is arranged at a position above any point on an upper surface of the first bottom plate portion and below any point on an upper surface of the second bottom plate portion.

2. The outdoor unit of claim 1, further comprising a foot portion mounted on a lower surface of the bottom panel, the foot portion being configured to support the casing, wherein:

the foot portion includes:

a first upper surface portion held in abutment on a lower surface of the first bottom plate portion, and a second upper surface portion held in abutment on a lower surface of the second bottom plate portion, and the first upper surface portion is formed at a position below the second upper surface portion.

3. The outdoor unit of claim 1, wherein the first bottom plate portion has a shape conforming to a peripheral shape of the heat exchanger in top view.

4. The outdoor unit of claim 1, wherein the first bottom plate portion and the second bottom plate portion are connected to each other by a tapered shape surface portion inclined with respect to the first bottom plate portion and the second bottom plate portion.

5. The outdoor unit of claim 1, wherein:

the bottom panel has a flange portion formed upright on a periphery of the bottom panel, the flange portion includes:

a first flange portion opposed to the heat exchanger, and a second flange portion formed in a part of the flange portion other than the first flange portion, and a height of the first flange portion is smaller than a height of the second flange portion.

6. The outdoor unit of claim 1, wherein the first bottom plate portion has a drainage hole configured to discharge drain water on the bottom panel.

7. The outdoor unit of claim 6, wherein the first bottom plate portion has a slope inclined downward to the drainage hole.

8. The outdoor unit of claim 1, wherein the first bottom plate portion includes a mounting base on which the heat exchanger is mounted.

9. The outdoor unit of claim 1, wherein:

the heat exchanger has an L-shape in top view, and the first bottom plate portion has an L-shape conforming to the peripheral shape of the heat exchanger in top view.

* * * * *